United States Patent [19]

Tatum

[11] Patent Number: 4,932,344

[45] Date of Patent: Jun. 12, 1990

[54] METHOD FOR PRODUCTION OF FITTED SHEETS

[76] Inventor: Harold Tatum, 5009 E. Manslick Rd., Louisville, Ky. 40219

[21] Appl. No.: 194,940

[22] Filed: May 17, 1988

Related U.S. Application Data

[63] Continuation-in-part of Ser. No. 51,732, May 19, 1987, abandoned.

[51] Int. Cl.[5] ..... D05B 1/00; D05B 97/00

[52] U.S. Cl. ..... 112/262.1; 112/262.3; 112/147; 112/121.15; 5/497

[58] Field of Search ..... 112/262.1, 262.2, 262.3, 112/121.15, 121.12, 147; 5/495, 496, 497

[56] References Cited

U.S. PATENT DOCUMENTS

| | | | |
|---|---|---|---|
| 3,208,419 | 9/1965 | Frydryk | 112/262.2 |
| 3,438,068 | 4/1969 | Anderson et al. | 5/497 |
| 3,783,805 | 1/1974 | Guichard | 112/147 X |
| 3,906,878 | 9/1975 | Burton | 112/262.3 X |
| 4,068,603 | 1/1978 | Arbter | 112/147 X |
| 4,245,365 | 1/1981 | Large | 5/497 |
| 4,462,322 | 7/1984 | Brocklehurst | 112/141 |
| 4,589,361 | 5/1986 | Starnes et al. | 112/262.3 |
| 4,594,956 | 6/1986 | Vartoukian et al. | 112/262.3 X |

*Primary Examiner*—H. Hampton Hunter

*Attorney, Agent, or Firm*—Edward M. Steutermann

[57] ABSTRACT

Method and apparatus to fabricate a unique fitted bedding covers from a generally rectangular blank of textile material of selected dimension which can permit automated operation to provide bedding covers which accommodate mattress corners and allows application of elastic to select portions of the sides of the blank in stretched condition to prevent movement of the cover when it is placed over a mattress. Bedding covers, methods and apparatus within the scope of the present invention also can be fabricated without cutting the rectangular blank or with cutting of the blank either prior to or after application of the stretched elastic material.

8 Claims, 9 Drawing Sheets

E
51
52
91
92
27
28
29
31
16
17
18
18A
19
19B
19C
20
20A
21

METHOD FOR PRODUCTION OF FITTED SHEETS

BACKGROUND OF THE INVENTION

This application is a Continuation-in-Part of application Ser. No. 051,732, Filed May 19, 1987 and now abandoned.

The present invention relates generally to fitted mattress cover such as bed sheets with rounded corners so that the bed sheet is not easily dislodged by movement of the persons occupying the bed and provides a neater appearance to the bed.

Fitted bed sheets and mattress covers are well known and the prior art recites numerous examples of fitted bed sheets and methods of making same, all of which have been available for a considerable period of time.

One example of a prior art fitted bed sheet is shown in U.S. Pat. No. 245,365 and provides an end pocket to receive an end of a mattress and hooks and eyes to secure the bottom of the pocket to the mattress.

Another example is shown: in U.S. Pat. No. 3,438,068 wherein a regular shaped self tucking sheet is shown which can be utilized with an elastic means to hold the sheet in postion. In another example, U.S. Pat. No. 4,422,195, a sheet arrangement is taught for use with a mattress having cut away corners where corner pockets are defined by the shape of the blank from which the sheet is fabricated but require extensive cutting and shaping for the blank to accommodate the mattress.

U.S. Pat. No. 4,384,380 illustrates yet another prior art arrangement where upper and lower sheets are provided to be notched and sewn together to provide double box corners as does U.S. Pat. No. 4,698,865.

Finally, U.S. Pat. No. 3,694,832 teaches a sheet arrangement where "V" shaped segments are cut out of the end of a retangular blank and opposite sides of the "V" in the end are matched in abutting relation and sewn in order to accommodate the corners of a mattress and to provide a fitted sheet. However, the arrangement shown would not, accommodate elastic material at the ends to hold the sheet in position. On the contrary the reference shows a complicated cutting matching and sewing procedure to form an underlying edge to be used to hold the sheet in place on the bed and does not provide for the use of elastic nor does the reference teach a procedure for automated production. Likewise, none of the prior art references teaches or even remotely suggests sttaching stretched elastic to selected edges of the blank and forming the blank into a mattress cover.

Briefly, no prior art of an arrangement is known which provides a method, apparatus and procedure for forming a fitted bed cover from a blank of fabric material where very little, and even no cutting is required and yet where the mattress cover such as a sheet can be produced by automated equipment to provide a product with means to accommodate rounded mattress corners and to provide elastic means to hold the sheet in position on the bed.

SUMMARY OF THE INVENTION

The present invention provides a new, useful, and straightforward method for production of a fitted mattress covers such as sheet from a rectangular blank of textile material where a minimum number of operations are required to produce the covers and where the operations are easily adapted to automatic processing so the expense incurred in the production of a fitted sheet is substantially reduced over the expense incurred in producing any known prior art fitted sheet or bedding cover.

The method and apparatus provided in accordance with the present invention can be utilized to produce fitted bed covers which can accommodate mattress with rounded corners. Further methods within the scope of the present invention provide means for inclusion of an elastic strip in the end panels of the sheet so that the end can be turned to form a corner and so that the sheet retains its shape on a bed and is also securely fastened to the bed.

More importantly sheets within the scope of the present invention are fabricated by procedures within the scope of the present invention which are easily automated so that the sheets can be mass produced with virtually no labor required whereby production cost is minimized.

Briefly, the present invention provides method and apparatus to fabricate a fitted bed sheet fabracated from a generally rectangular blank of fabric material of selected dimensions which permits automated operation to provide sheets which accommodate rounded mattress corners and provide intergral elastic ends to prevent movement of the sheet on the mattress.

While various means methods and procedures to accomplish the objectives of the present invention will become obvious to those skilled in the art upon reading the disclosure set forth hereinafter, the figures illustrate on such method which it will be understood is presented for illustration only and not by way of limitation.

BRIEF DESCRIPTION OF THE DRAWINGS

Referring now to the Figures which illustrate one method within the scope of the present invention:

FIGS. 2A–2D illustrate operation of a portion of the device shown in FIG. 1;

FIGS. 4A–4B is a schematic illustration of the operation of a portion of the belt conveyor system utilized in the apparatus shown in FIG. 1;

DETAIL DESCRIPTION OF THE DRAWINGS

Figure 1:
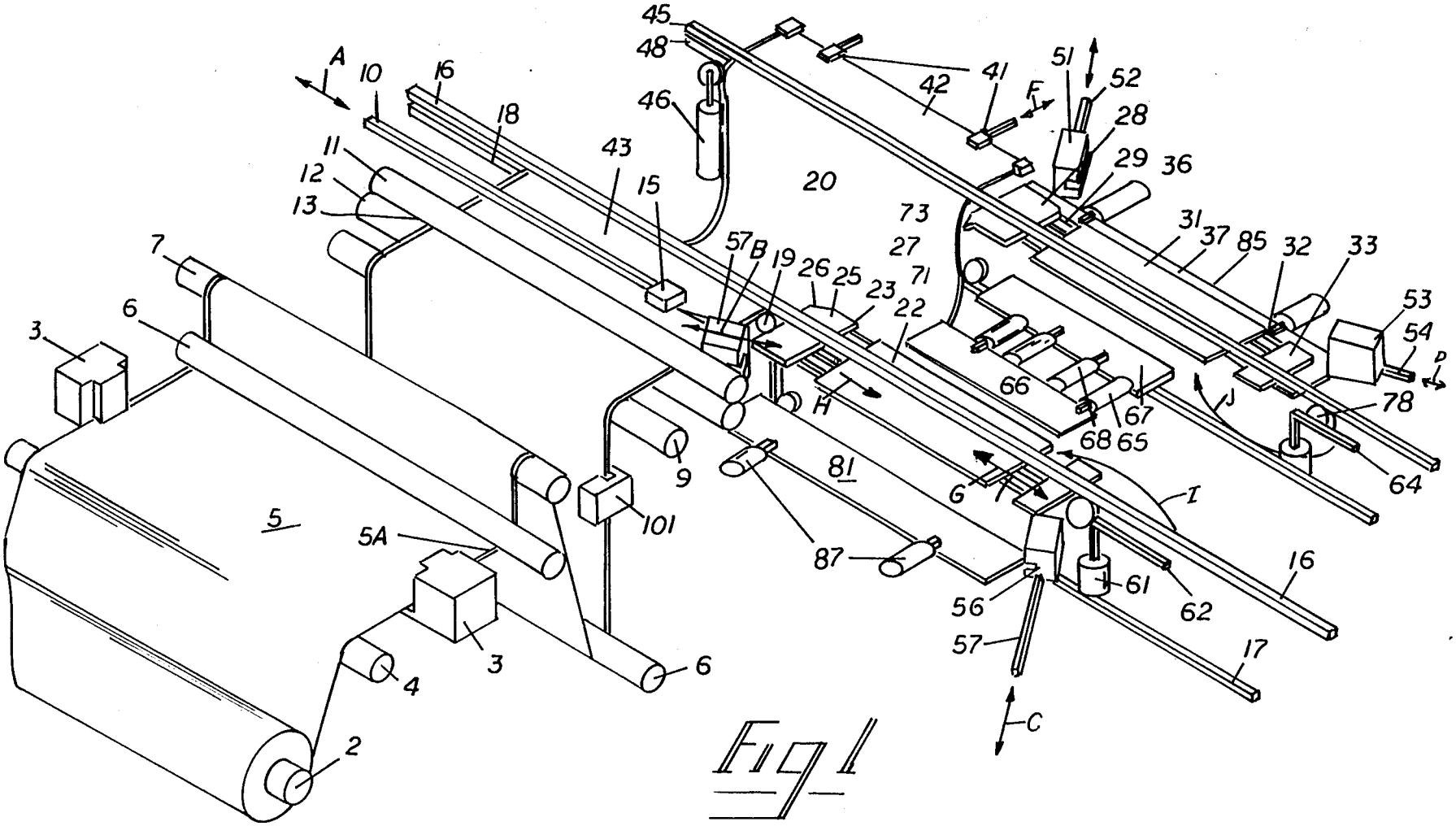
FIGS. 1A–1G illustrate in perspective the steps of one example of a fabrication procedure and apparatus within the scope of the present invention to produce a sheet.

FIG. 1, illustrates, in perspective view, an example of an apparatus to execute Procedures within the scope of the present invention discussed hereinafter to produce a fitted mattress covering, such as a fitted bed sheet. The essential working elements comprising the apparatus are shown as they would be located in a framework common in the art which it is to be understood would ordinarily be provided to support the necessary elements, but which framework, for purposes of clarity of illustration and description, is not shown.

In the arrangement shown in FIG. 1, a reel of textile material, for example a bolt of material 1 from which a sheet could be made is carried on a spindle 2 and fed over an idler roller 4 as a web to two hemming machines 3 located on either side of 5 where, as is known in the art a hem portion is turned in and the sheet material. side hems 5A are then sewn into the web, which is then passed over idler rollers 6 and 7 and a tensioning roller 8, which as is known in the art can be biased to maintain the tension of the web 5 in the device. The hemmed web is then passed over a roller 9 and through a nip 13 formed between feed rollers 11 and 12 which pull the material off the roller 1 at a rate determined by the speed optimum of operation of the device controlled by the speed of the motive means (not shown) which drives rollers 11 and 12. An encoder device 101, as is known in the art, can be provided to measure the amount of material which has been withdrawn from the roller 1 and fed throught the rollers 11 and 12.

The initial hemming step is then followed by a procedure where a portion of the web is cut and formed into a sheet as described hereinafter.

Figures 2A, 2B, 4A, 4B:
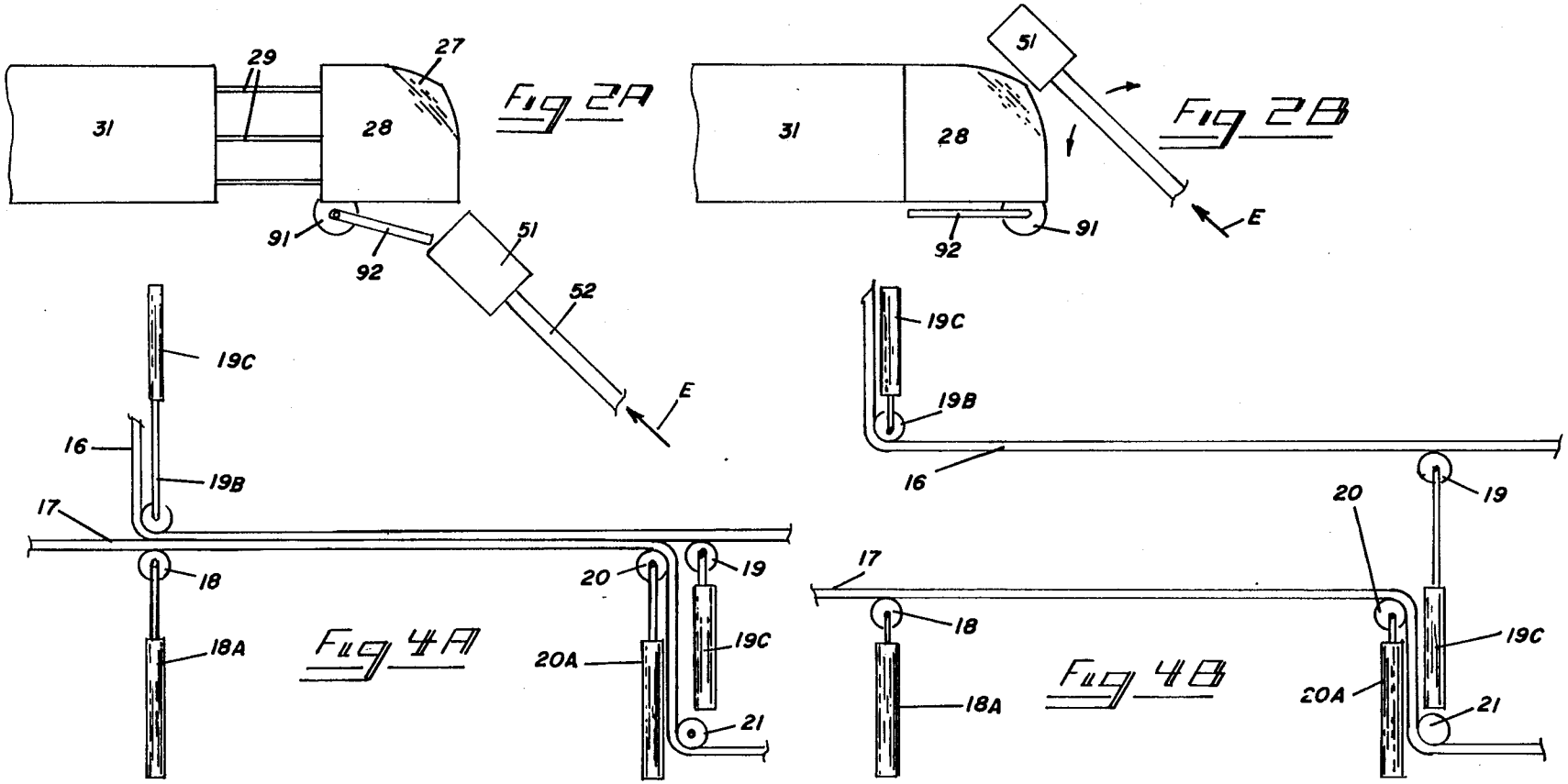

In the next stage the hemmed wed 50 is fed between upper belt 16 and lower belt 17 which can move in a direction transverse to the direction of feed of the web 5. Belt 17 is carried by a pulley system including pulleys 18, 20 and 21 as shown in FIGS. 1 and 4A–4B. Whole only segments of the belts are shown tt will be understood that the belts 16, 17 are continuous endless belts which are carried in a track including other necessary pulley and guide arrangement as known in the art but for purposes of illustration only the portion of the belt tracks which are integral to the operation of the device are illustrated in detail in FIGS. 1 and 4A–4B.

Belt 16, is likewise carried by pulleys 19–19A, (shown in FIGS. 1, 4A–4B) which can be moved vertically as described hereinafter. The web 5, is fed between the pulleys 16 and 17 toward a second set of belts 48, 49 which are located in spaced distance from the belts 16 and 17 and adapted to travel parallel therewith. Belt 48, is carried on a pulley system including pulleys 47, 73. Pulley 47 is carried by positioning means, for example a fluid cylinder 46 to allow pulley 47 to be raised to the position shown in FIG. 1 and dropped to the position shown in FIG. 3A. A similar arrangement is provided with respect to pulley 73 so that the pulley pairs on opposite sides work cooperatively to open and then close on the fabric section.

Figure 3A:
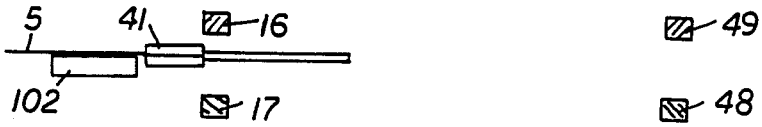
FIGS. 3A–3F illustrates an end view of the procedure accomplished by the apparatus illustrated in FIG. 1.
Figure 3B:
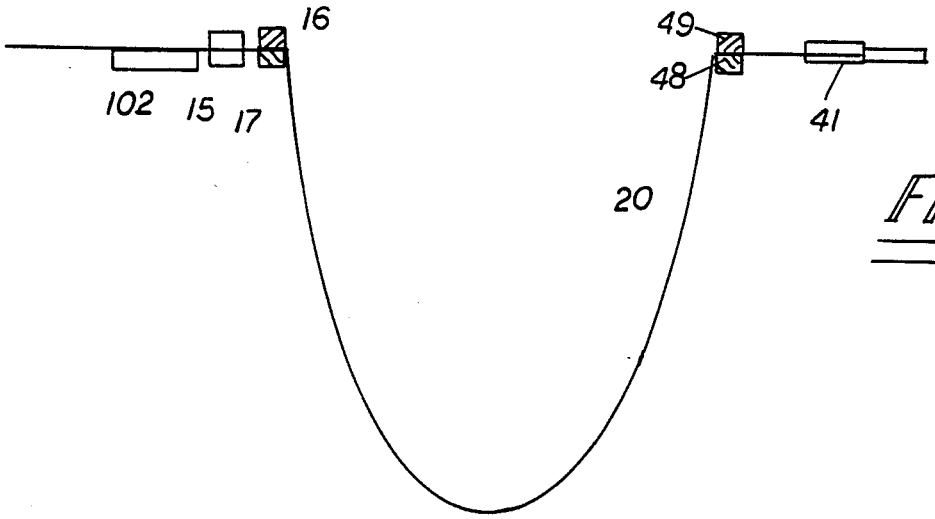

As shown in FIGS. 3A–3B and described hereinafter, grips 41 are provided outside of the belts 48, 49 to reach between the belts 48, 49 when pulley 47, 73 are in the lowered position and catch a leading edge of the web 5 and pull it through the belts 48, 49 at which time the belts 48, 49 are closed as shown in FIG. 3B to retain the webs between the belts with a portion 42 located outside the belts as shown.

With reference to FIGS. 4A–4B pulleys 19–19A are carried by positioners for example, fluid cylinders 19B, 19C to allow belt 16 to be raised where belt 17 is carried by pulleys 18, 20 carried by positioners for example fluid cylinders 20A, 18A to allow the belt to be lowered as shown in FIG. 4B to allow passage of the web and grip 41 therebetween.

After the belts 48, 49 are closed and a selected quantity of the web material has been fed between belts 16 and 17 to form a loop 20A as shown in FIG. 3B, belts 16 and 17 close in a manner similar to the manner of closure of the belts 48, 49 as described hereinbefore leaving a second outer segment 43 as shown in FIGS. 1, and 3B. At this time a cutter 15, shown in FIG. 1, is activated (by control means not shown but understood in the art) and carried by a bracket 10 to move in a direction shown by the arrow A to cut the material to a selected length.

Figure 3C:
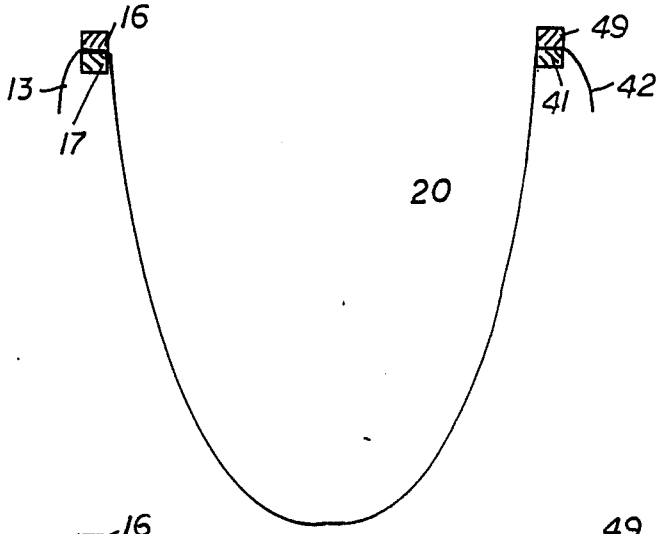
Figure 3D:
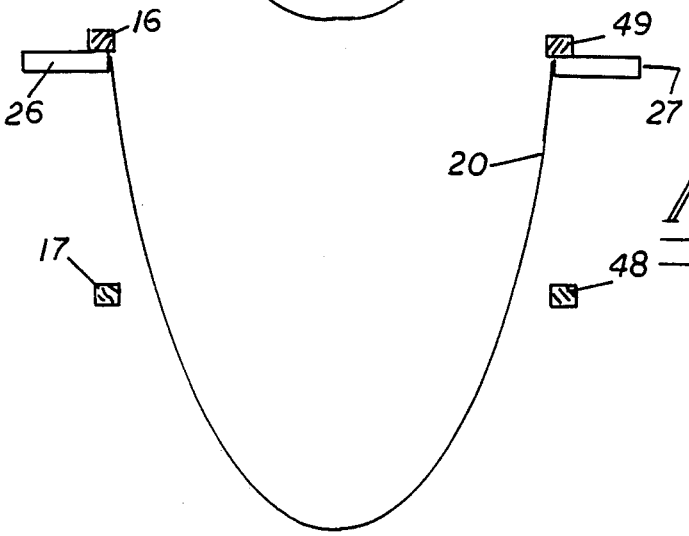

As shown in FIG. 4A, and previously described, belts 48, 49, and 16, 17 are guided by the pulley systems to convey the cut material, which forms a sheet blank, in the direction shown by arrow A with the outer sections 42, 43 as shown in FIG. 3C to be received on a pair of platens 22 and 28. In the arrangement shown in FIG. 1, and FIG. 3D a platen 22 is provided on one side of the blank with end platen 25 having a curved guide 26 which is adapated to receive the portion 43 of the material as the belt 16 moves forward as shown in FIG. 3D.

Likewise, a second platen 28 is provided on the opposite side having a downwardly curved guide 27 to receive portion 42 of the material as the belt 49 moves forwardly. It will be understood the arrangement is adapted to move the material blank onto the platen sections 25, 28 as the belts 16 and 49 move forward as shown in the Figure. Belts 17 and 48 then move away from belts, 16 and 49 as the sheet material is fed onto the platens by means of the pulley system as previously described.

In accordance with another feature of the arrangement shown in FIG. 1, a second platen portion 24 is provided for platen 22 and a second platen portion 33 is provided for the platen 31 as shown where the platen section 28 is connected to platen 31 by means of a rack 29 and the platen section 33 is connected to the platen 31 by means of a rack 32. Platen section 26 is connected to platen 22 by means of a rack 23 and the platen section 24 is connected to the platen 22 by means of a rack 30. It will be understood that longitudinal movement of the racks can be controlled and sequenced by control means (not shown) so that the platen sections are drawn to a butting relation with the main platen section 22, 31 as described hereinafter. Sheet section 43 is received on the platen section 26, 22, 24, and the section 42 is received on the platen section 28, 31, and 33 by movement of the belts 16 and 49 on the platen sections as shown in FIG. 3D with the elements of the platen sections in extended relation as shown in FIG. 1.

The platen sections 24, 25 then are drawn to abutting relation with the platen 22, and the platen sections 28 and 33 are drawn to a abutting relation with the platen 31 as shown in FIGS. 2A–2B leaving the outer edges of the sheet material extended so that cutting and sewing machines 51, 53, 56, 57, can be moved in directions indicated respectively by the arrows E, B, C, D, to cut and sew the edges of the material as described hereinafter. Cutters 51, 53, 56, 57 can be operated and positioned by various menas but in the arrangement shown the cutters/stitcher 51 is carried by an arm 52, cutter/- stitcher 53 is carried by an arm 54, cutter/stitcher 56 is carried by an arm 57 and cutter/stitcher 57, is carried by an other arm (not shown).

Figure 3E:
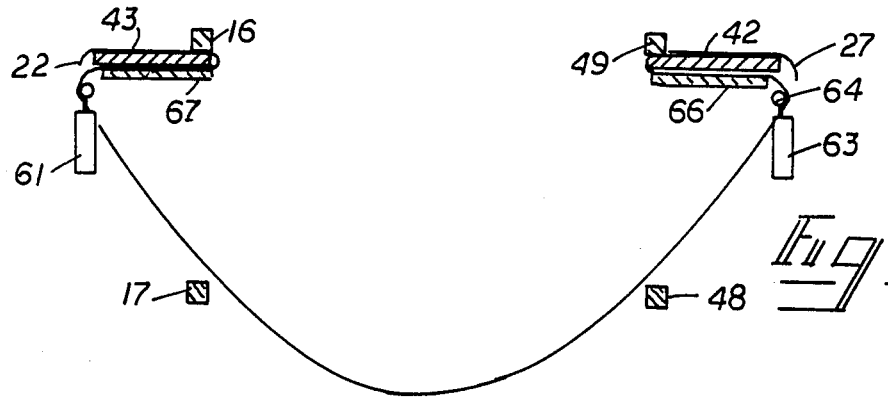
Figure 5:
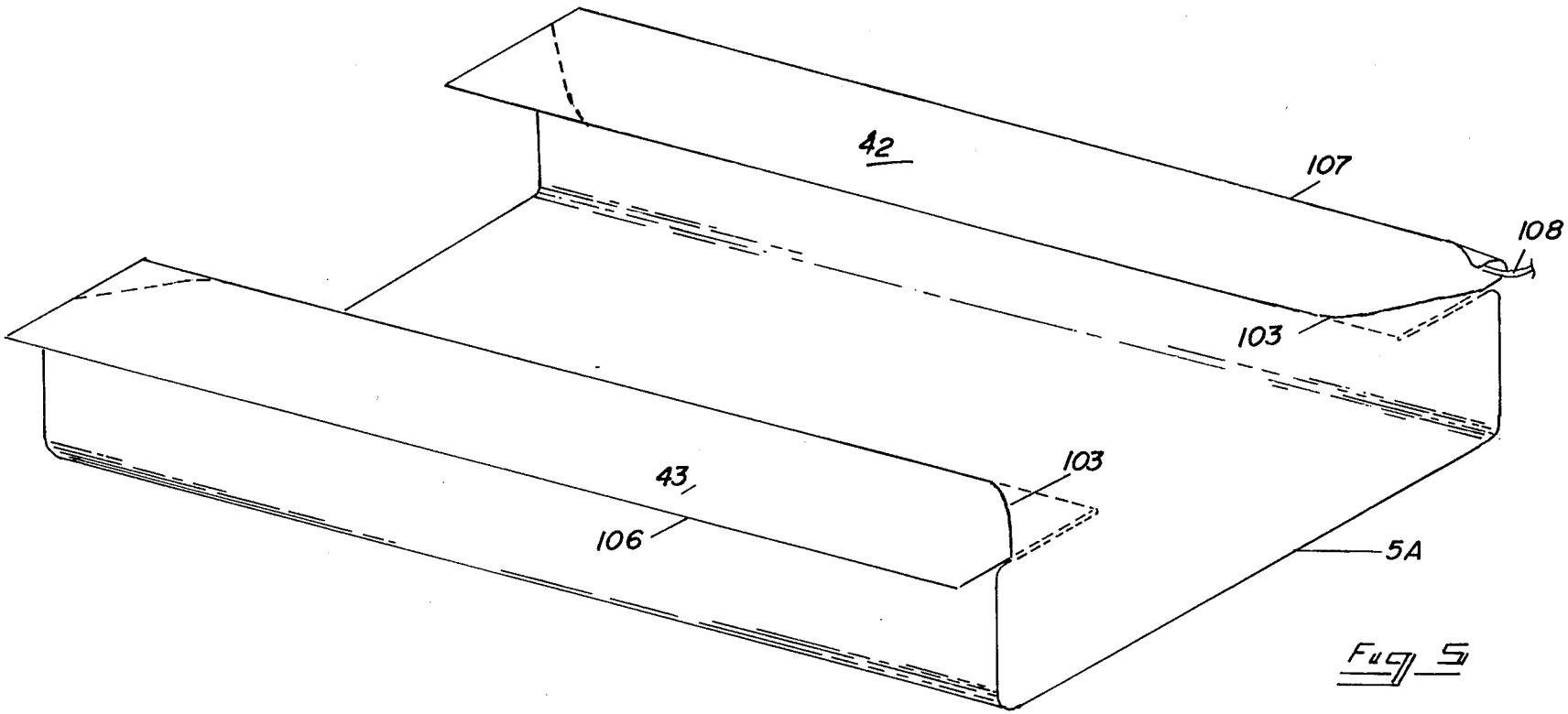
FIG. 5 is another view of illustrating the operation accomplished by the apparatus and procedure illustrated in FIG. 1.

Also platens 66 and 67 are moved laterally by actuators 65 and 68 to fold the material adjacent to platens 22, and 31 as shown in FIGS. 5, and 3E as adjacent edges of the material are sewn together.

Finally, platens 81, and 80 are engaged and moved inwardly to leave an outer edge of the portions 42 and 43 for receipt of elastic material as described hereinafter.

Arms 62 and 64 carried by actuators 61 and 63 are provided to rotate throught arcs I and J as shown to move the fabric out of way to accomplish the cutting and stitching operation shown in FIGS. 5 and 3E.

FIGS. 2A–2B illustrate the method of operation previously described for sewing the corners of the sheet where the platen 31 is illustrated with the outer platen 28 connected by the rack 29. In FIG. 2A, the cutter/-stitcher 51 is shown in retracted position on bracket 52. An arm 92 which is similar to the arms 62 and 64 is provided on an actuator 92 at the end of the arrangement which as shown. Initially, the platen portion 28 is withdrawn to abutting relation with platen 31, and the arm 92 is rotated 180° to engage the the material to draw a portion of the material out of the way so that the cutter/stitcher 52 can be advanced by the arm 92 to make the cut and the stitch illustrated in FIG. 5.

Figure 6:
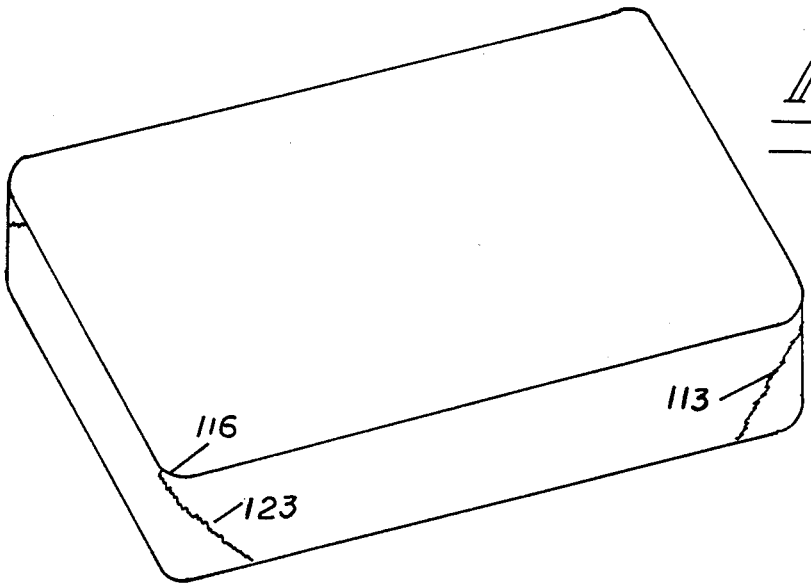
FIG. 6 is a perspective view of an example of a sheet produced in accordance with the present invention on a mattress.

Also the arm 52 can be moved in an arc as shown by arrow J to provide a rounded corner in accordance with another feature of the present invention as described with reference to FIGS. 5 and 6.

It will be understood further that a similar arrangement is provided and a similar motion occurs at each of the platen sections 24, 26, 28, and 33.

Reference is now made to FIGS. 3A–3F which illustrate the sequence of operation which have just been described with reference to the equipment.

In the arrangement shown in FIG. 3A, the material 5, has been fed over a table 102 which is not shown in FIG. 1, where the grippers 41 have received the edge of material 5. Belts 16, 17, 48, and 49, have been separated as discussed with reference to the illustration of FIGS. 1, 4A, and 4B. The gripper 41 is then drawn in the direction shown by the arrow F to withdraw the material between the belt pairs 16, 17, 48, and 49 as previously described.

When the gripper 41 has reached a preselected location the belts 48, and 49 are then closed by mean of the arrangements shown in FIG. 4A and 4B to hold one end of the material. The material is continued to be fed to form the loop 20A, and when the selected length of material has been fed between the belts 16 and 17, belts 16 and 17 close and the cutter 15 is actuated to cut off the length of material.

As shown in FIG. 3C, the material 20 is then moved forward with the edges 43, and 42 loose until as shown the platen sections 26 and 27 are engaged at which time the ends 42, and 43 are raised to the position shown. FIG. 3D, also illustrates the position of the belts 16 and 49 and shows the belts 17 and 48 in the lowered position.

FIG. 3E illustrates the insertion of the tuck bars 66 and 67 which provide the fold in the material to accommodate passage of the cutter/stitches as previously described. Further the operation of the actuator 63 to move the bar 64 is also shown as a means of moving the fabric out of the way so the cutting and stitching operation previously described can be accomplished.

Figure 3F:
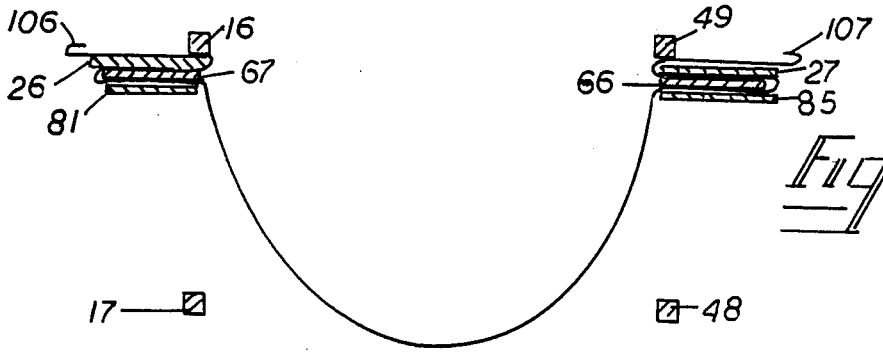

In FIG. 3F the tuck bars 81, and 85 are shown in position to facilitate the elastic stitching as described hereinafter.

Reference is now made to FIG. 5 which is an illustration of the final operation where the matress seams 102 have been sewn with the material sections 42, and 43 shown and where the outer edge of the material 106, and 107 are shown where elastic is to be seamed into the material. It will be understood that in the arrangement shown in FIG. 5 also shows the shape of the sheet in the configuration illustrated in FIG. 3F. As shown elastic strip 108 is laid on the outer section, for example, section 107 which is in folded over and sewn into the hem by a sewing machine which travels the length of the sheet is operated by means of an arm 112 along the edge of the sheet to sew the elastic into the sheet and to allow the full use of the invention.

It will be understood that a similar arrangement is provided along the edge 106 where additional elastic material is sewn. It is understood that the elastic material, in conjuction with the rounded corners 105 which are provided by movement of the cutter/ stitchers 51, 53, 57, and 61 as described with reference to FIG. 2B provide one advantageous features of the present invention, namely the ability of the sheet to fit on a mattress with rounded corners as illustrated in FIG. 6 where the configuration can been seen to include the stitches 103, 113, to allow the accommodation of the rounded corner 116, of the mattress.

FIGS. 7A–7D, 8, 9A–9C illustrate a method, product, and apparatus in accordance with the present invention for production for another mattress covering within the scope of the present invention.

It will be understood that one side of the covering being formed is illustrated and that while the motions and methods described hereinafter are occuring at one side of the sheet, similar motions are occurring at the opposite side of the sheet.

Figures 7A, 7B, 7C, 7D, 8:
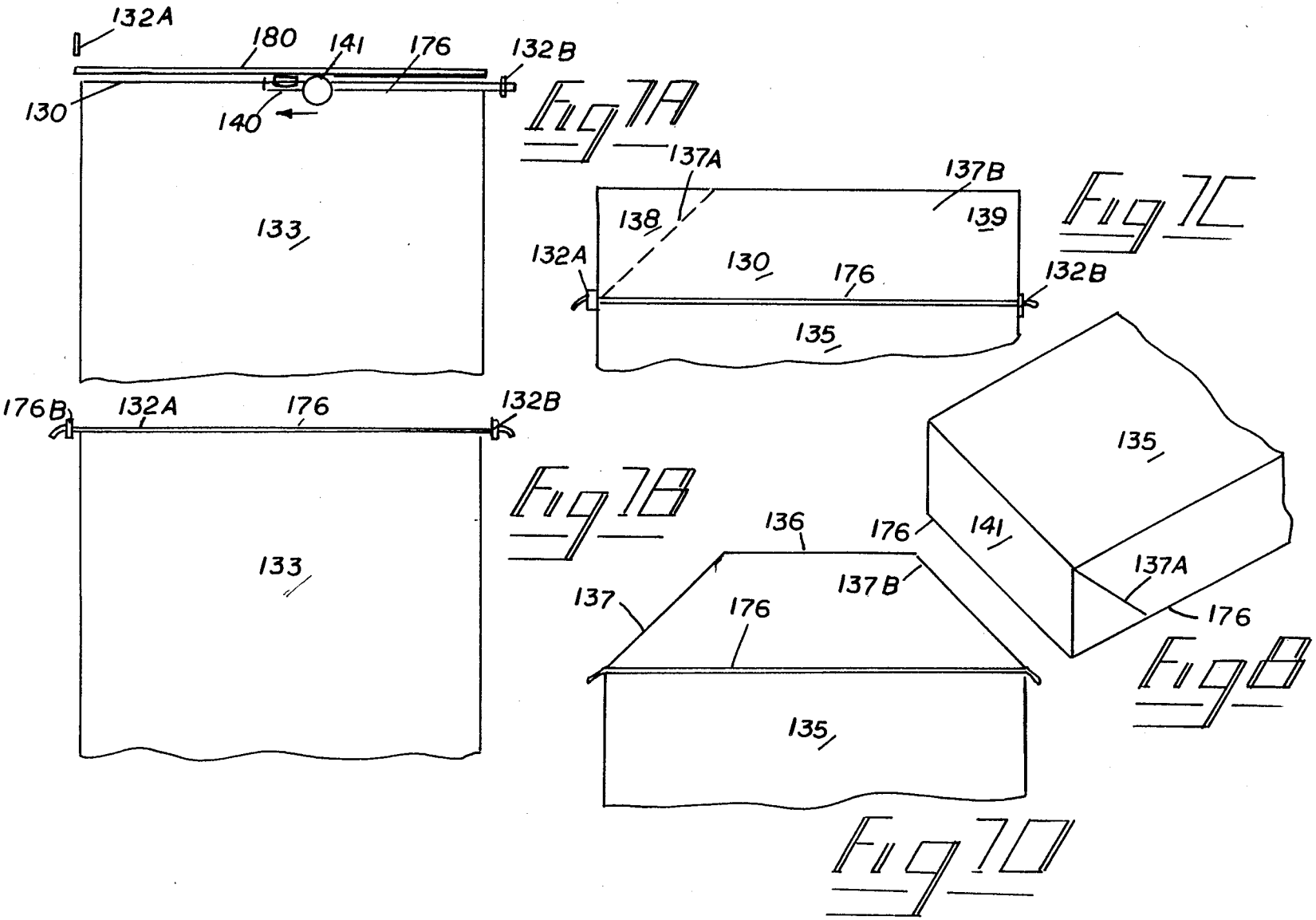
FIGS. 7A–7D illustrate sequentially example of a procedure to manufacture a bed cover within the scope of the present invention.
FIG. 8 is a perspective view of a portion of a fitted mattress covering within the scope of the present invention.

Referring first to FIG. 7A a textile blank 133 is shown along with clamps 132A, and 132B which can be moved as described hereinafter along lines G as shown. The clamp 132B is adapted to pickup one end of an elastic strip 131 in connection with the movement and the motion illustrated by the arrows.

Elastic is secured in stretched mode along one edge 130 of blank 133 in the arrangment shown. A reel feed mechanism 175 and stitcher are carried by conveyor 131 along edge 130 to feed elastic 176 in stretched condition for attachment to edge 130. One end 176A of the elastic is held by clamp 132B during the attachment.

In FIG. 7B the elastic strip 176 has been fully attached and end 176A, 176B are gripped by the clamps 132A, 132B and the blank is stretched to full width as shown with the elastic strip in extended condition. It will be understood that during the operation of the formation of the sheet the elastic remains between the clamps 132A, and 132B in the extended condition. The next step is illustrated in FIG. 7C where the edge 130 of the blank 133, to which the elastic strip 176 has been attached, is turned over the blank 133 leaving a top body section 135 as described hereinafter and forming an upper crease 136. In the next step stitches are taken represented by the dotted lines 137A, 137B to form selvage sections 138, 139 which, within the scope of the present invention, can either be cut away as shown in FIG. 7D or can be left on the sheet inasmuch as the sheet is turned inside out as shown in FIG. 8. in Figures crease 136 is shown along with the end panel 141 and the seam section 137A which extends angularly down the side 142. The top section 135 is formed as shown to cover the top of the mattress. In use the sheet is in the position shown in FIGS. 8 in order to fit over a mattress and it has been found that when a sheet is fabricated by the general method previously described the sheet fits extremely well and is easily placed onto and removed from a mattress.

While the foregoing description relates to a sheet it will be understood that an equally advantageous arrangement within the scope of the present invention can be utilized for the formation of any type of a mattress covering or, for that matter for any generally rectangular object.

Turning now to FIGS. 9A–9D which illustrate an apparatus in accordance with the present invention for use in the fabrication of mattress covers within the scope of the present invention, the apparatus is shown in free form relation in order to more clearly illustrate the operation of the device without the encumbrances which would normally be provided by framework etc., which is well known in the art; it being understood only that the elements illustrated and described hereinafter would necessarily be supported in the proper orientation and position to accomplish the objective for which they are intended.

Figures 9A, 9B:
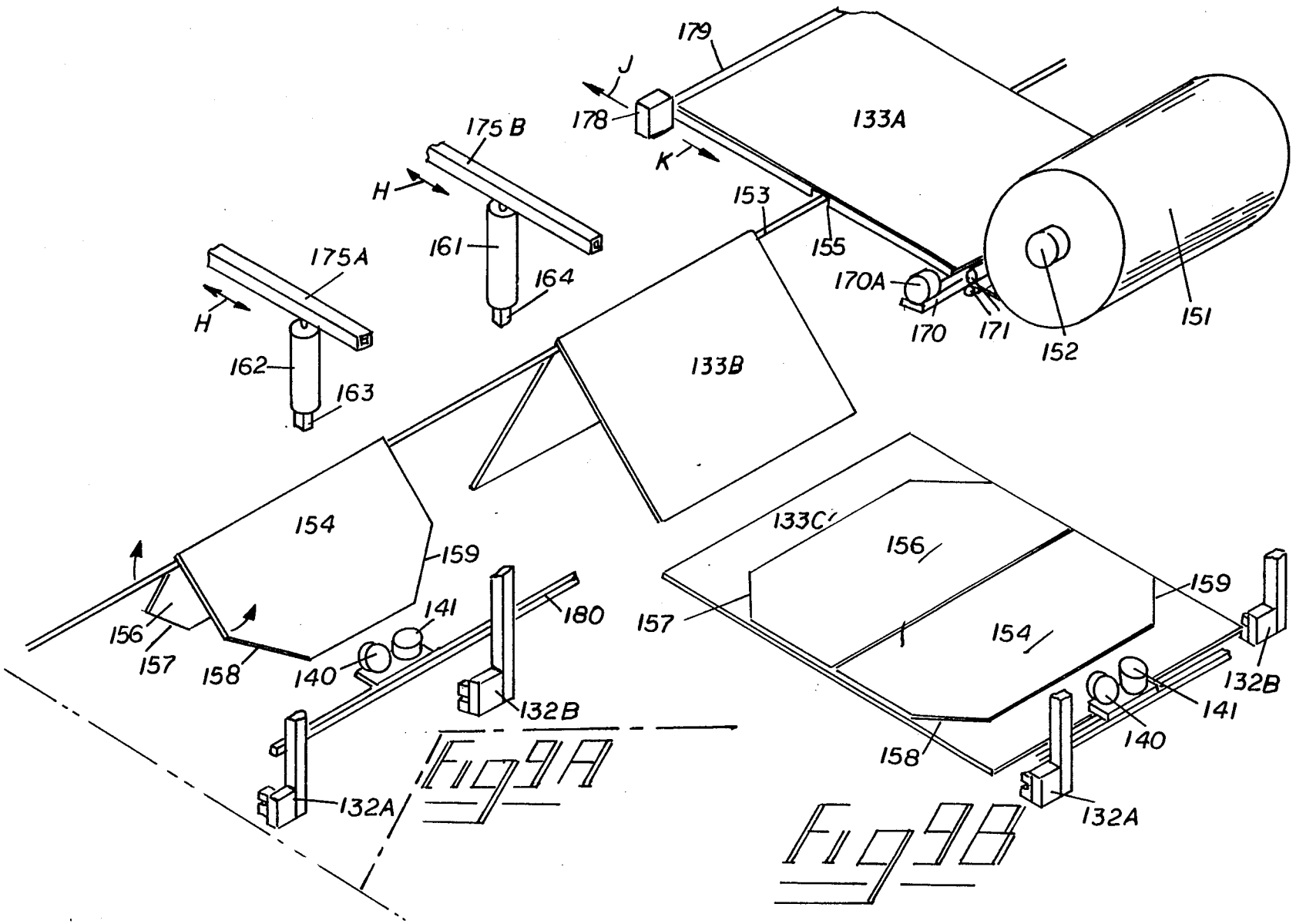
FIGS. 9A–9D illustrate examples of apparatus and procedures useful in accomplishing objectives in accordance with the present invention.

Referring first to FIG. 9A, a roll of textile material 151 is carried on spindle 152. In accordance with the present invention a take up 178 is provided having clamps 179 to move as shown by the arrows J and K to pickup an end of the textile material 151 and move the fabric in the direction shown by the arrow J until an appropriate length has been withdrawn at which time a cut 150A is made in the leaving a length 133A, similar to the blank 133 shown in FIG. 7A of the proper length and width to form the covering of the desired configuration. Blank 133A, as shown, is supported on a table 150 having a central opening 155 in which a conveyor 153 is received for movement of the blanks in the direction X as shown. A preceeding blank 133B has been removed from the table 150 and is moving as shown in FIG. 9A toward an operating station.

An example of an operating station, is shown in FIGS. 9A–9D which in general functions as shown in FIGS. 7A–7D and includes a table composed of elements 154, 156 which can be pivoted, (by pivot means not shown) in the direction shown by the arrows S and T. The blank 133B is placed on the tables 154, 156 which are then raised as shown in FIG. 9B. Table 154 includes cut off ends 158, 159 while the table 156 includes the cut off end 157A and 157B.

Figures 9C, 9D:
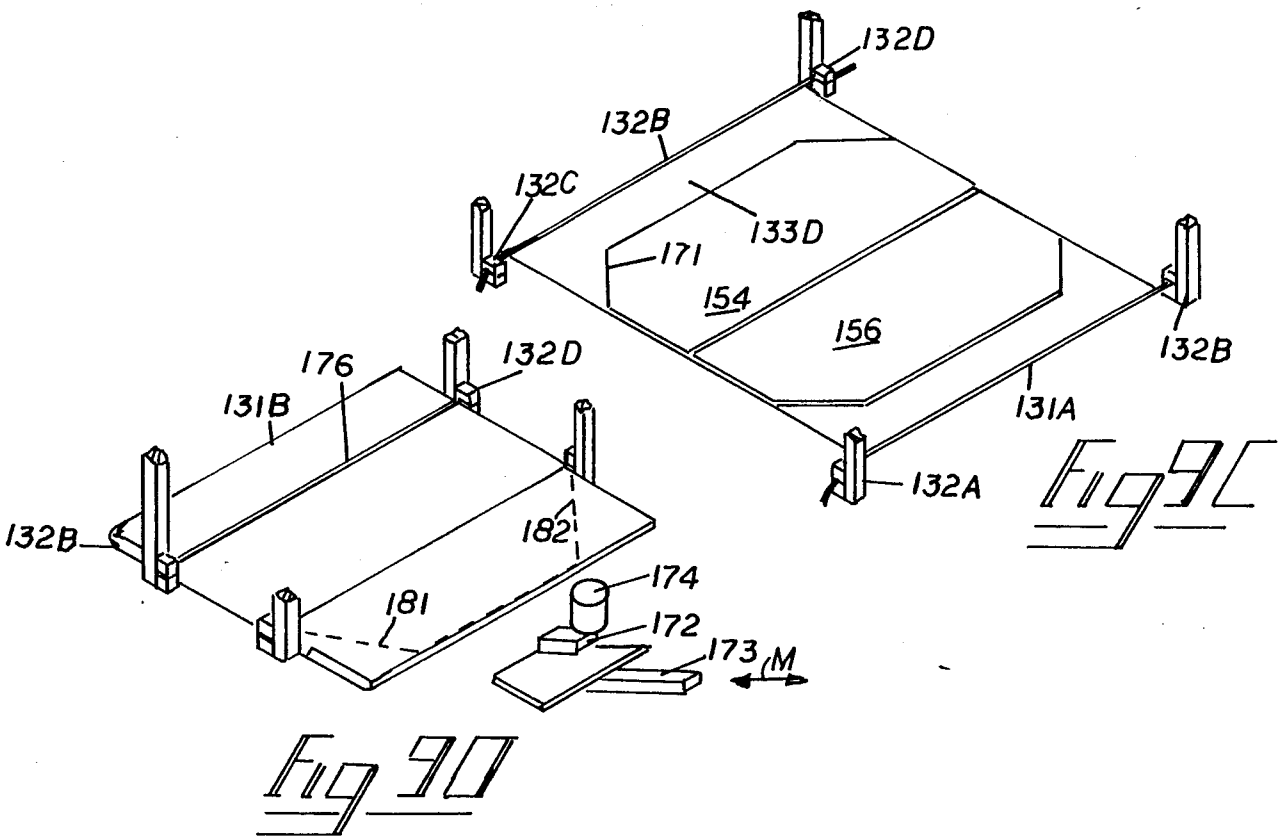

An overhead brackets 175B are provided to hold cylinders 161, 162 having shafts 163, 164 which are adapted hold retainers 166A, 166B which receive the clamps 132A, 132B as shown in FIG. 7A. It will be understood that at the opposite side of the table, namely at the table 156 a similar arrangement is provided. Elastic 131 is fed from a reel 140 to be received between the clamps 132B, 132A. Cylinder 161 is moved in the direction shown by the arrow H to move the clamp 132B to grip the end of elastic as shown in FIG. 7A. The feeder 141 the traverses the length of the blank and adjusted to electively stretch the elastic and secure it for example by sewing onto the textile in stretched mode. The feeder 140 tranverses the fabric by means of a conveyor 181 which, as is known in the art can move the feeder at a selected rate after feeder 140 has finished its tranverse the elastic is clipped (by means not shown) after clamp 132A has been advanced to position on conveyor 175A and clamp 132 secures the other end of the elastic. In the meantime similar operations have occured at the opposite side of the table and where the entire arrangement is shown in FIG. 9C with the extended elastic strips 131A and 131B in place on opposite sides of the blank 133C. The conveyor 175A, 175B and the corresponding conveyor (not shown) on the opposite side of the device are moved in the general direction shown by the direction of arrow H in FIG. 9A to move the elastic strips 131A and 131B and the associated fabric over the tables 156, and 154 as shown in FIG. 9D so that a cutter/sewing combination 174, which is illustrated as carried by a platen 172 and moved on a conveyor device 173 in the direction shown by the arrows M, can be adapted to either sew along the lines shown as 181, 182 to form the product shown in FIG. 7C or to sew and cut the selvage from the blank to form the arrangement shown in FIG. 7D where in either case the product shown in FIG. 8 results.

Figure 10B:
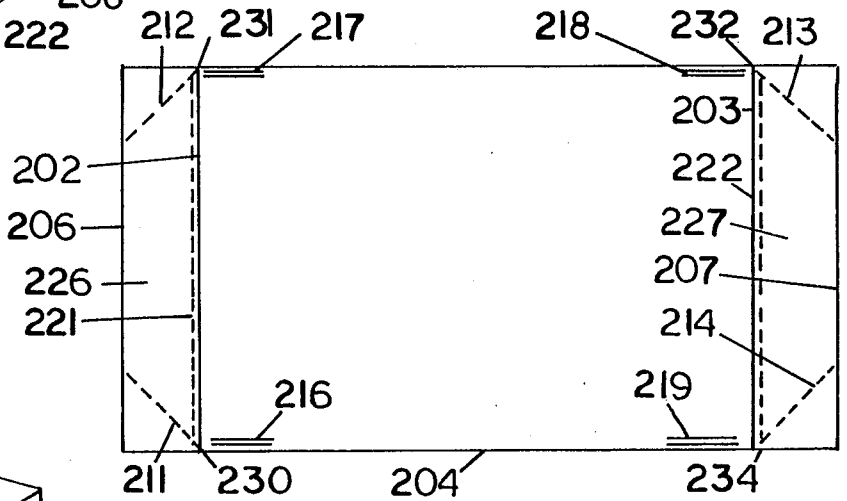
FIGS. 10A–10C illustrate an example of another method of forming a mattress cover from a textile blank within the scope of the present invention.
Figure 10A:
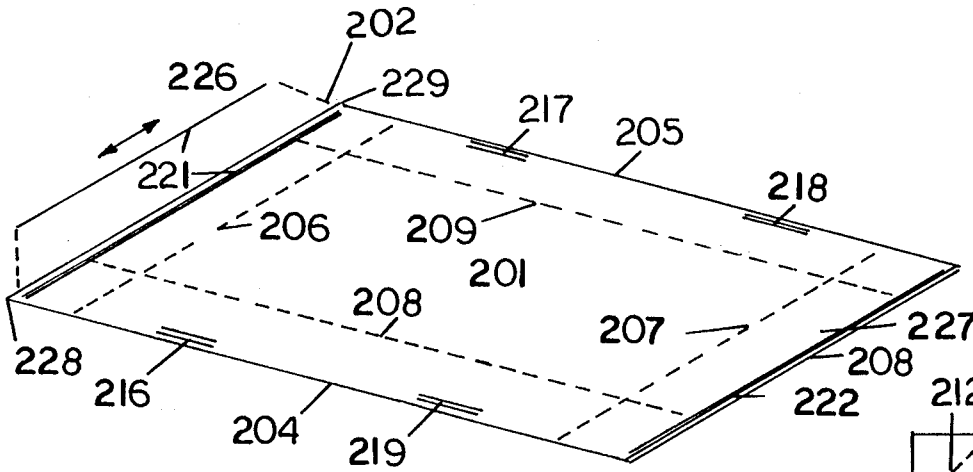
Figure 10C:
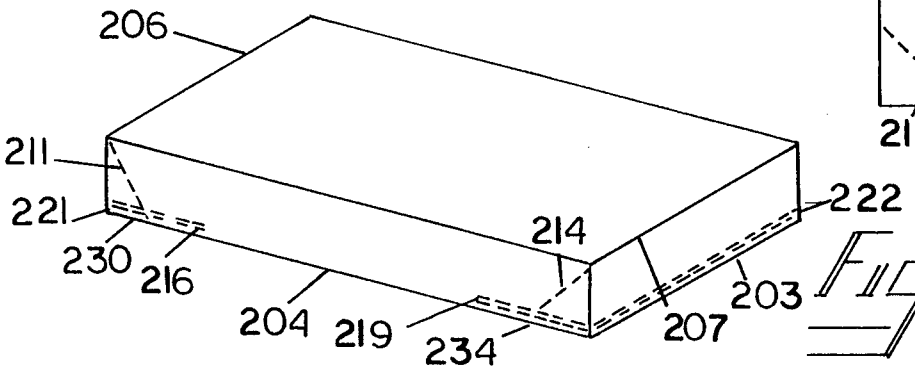

FIGS. 10A, 10C illustrates another arrangement within the scope of the present invention where a blank 201 is provided. The fold lines are illustrated by the lines 206–209. In FIG. 1 elastic strips 221, 222 have been sewn parallel to the end edges 203, 202. In the parctice of the invention the elastic is stretched as shown by the arrow and sewn to the fully extended portion of the edges so that upon release the elastic will draw and gather the material. The degree of draw is determined by the particular application and the degree of stretch applied to the elastic material when it is attached to the edge of the material. While FIG. 10A shows the elastic 221, 222 sewn across the entire length of the end edge in some applications such an arrangement is not necessary.

Also elastic sections 216–219 are shown sewed to the side edges 204–205. The additional elastic on the sides is optional and can be provided or not as the application demands. In any event it is located on the side to avoid contact with the strips 221, 222.

FIG. 10B shows the arrangement where the end sections 226, 227 have been folded back over a portion of the blank 201 so that the corners 228, 229 are respectively located at the points 230, 231 of the sides of the blank and the corners 232, 233 are located at the locations 232, 134. The corners are then fastened to the side edges 204, 205 as shown. The excess material out side the lines 211–124 can be removed or sewn back to the sides of the blank as desired. In any event the arrangement shown in FIG. 10 is provided where a completely encapsulated sheet is formed and the elastic segments at the corners of the arrangement adjacent the point 228, 229, 232, 233 extend around the corners to form tension side panels. As shown also, the elastic strips 216–219 can be provided to supply additional tensioning.

It will be understood that the foregoing are but a few examples of arrangments within the scope of the present invention and that various other arrangements also within the scope of the present invention will occur to those skilled in the art upon reading the disclosure set forth hereinafter.

The invention claimed is:

1. A method of forming a sheet which comprises: cutting a length of textile material; supporting said length of material at opposite sides thereof and allowing portion intermediate said supported sides to sag, inserting first guide means under said opposite side and then placing second guide means to engage said portion of said material which is saging and inserting said second guide means below said first guide means to form an overlying layer of said material, sewing the outermost edges of said underlying portions of said material.

2. The invention of claim 1 including turning the outermost edge of said overlying portion back onto the uppermost portion thereof and sewing lengthwise along said turned back portion to form a channel to receive an elastomeric material.

3. A method of forming a sheet which comprises: cutting a length of textile material into a generally rectangular blank having first and second end edges method; attaching elastic means, in extended condition, along a portion of at least one of said end edges, turning said at least one end edge back over a portion of said blank to form an overlying layer to form a fold line and fastening said overlying layer to said rectangular blank along lines extending from said end edge to said fold line.

4. The invention of claim 3 wherein said angle is 45°.

5. The invention of claim 3 wherein, said overlying layer is fastened to said blank along lines extending from the outer corners of said end edge.

6. The invention of claim 5 wherein said lines extend at an angle relative to said fold line.

7. The invention of claim 3 wherein said blank has first and second side edges extending in generally parallel spaced relation between said first and second end edges, and inlcuding securing elastic material in stresses condition to at least one of said first and second side edges while said one of said first and second side edges is in substantially straightened condition.

8. The invention of claim 7 wherein said overlying layer is fastened to said blank along lines extending from the outer corner of said end edge.

* * * * *